US009950250B2

(12) United States Patent
Shoemaker, Jr.

(10) Patent No.: US 9,950,250 B2
(45) Date of Patent: Apr. 24, 2018

(54) ARCADE GAME WITH ROTATING TARGETS

(71) Applicant: Stephen P. Shoemaker, Jr., Redondo Beach, CA (US)

(72) Inventor: Stephen P. Shoemaker, Jr., Redondo Beach, CA (US)

( * ) Notice: Subject to any disclaimer, the term of this patent is extended or adjusted under 35 U.S.C. 154(b) by 0 days.

(21) Appl. No.: 15/221,545

(22) Filed: Jul. 27, 2016

(65) Prior Publication Data

US 2018/0028905 A1 Feb. 1, 2018

(51) Int. Cl.

| | |
|---|---|
| ***A63B 67/00*** | (2006.01) |
| ***A63B 71/00*** | (2006.01) |
| ***A63F 9/00*** | (2006.01) |
| ***A63F 9/30*** | (2006.01) |
| ***G07F 17/32*** | (2006.01) |

(52) U.S. Cl.
CPC ..... *A63F 9/30* (2013.01); *A63F 9/0079* (2013.01); *G07F 17/3255* (2013.01); *A63F 2009/0081* (2013.01)

(58) Field of Classification Search
CPC ..... A63F 9/24; A63F 9/30
USPC ..... 273/447, 448; 463/7
See application file for complete search history.

(56) References Cited

U.S. PATENT DOCUMENTS 4,726,585 A * 2/1988 Shoemaker, Jr. ..... A63F 9/00 221/209
4,778,176 A * 10/1988 Shoemaker, Jr. ..... A63F 9/30 212/225
5,275,402 A * 1/1994 Malavazos ..... A63F 9/00 273/138.2
5,553,865 A * 9/1996 Shoemaker, Jr. ... G07F 17/3297 108/20
5,855,374 A * 1/1999 Shoemaker, Jr. ..... A63F 9/30 273/447
7,192,342 B2 * 3/2007 Shoemaker, Jr. ..... A63F 9/30 273/138.3
8,251,370 B2 * 8/2012 Guarnieri ..... A63F 9/30 273/447
2007/0296146 A1 * 12/2007 Omoto ..... G07F 17/3211 273/138.3
2016/0379450 A1 * 12/2016 Shoemaker, Jr. ... G07F 17/3297 273/447

* cited by examiner

*Primary Examiner* — Gene Kim
*Assistant Examiner* — Christopher Glenn
(74) *Attorney, Agent, or Firm* — Fulwider Patton LLP

(57) ABSTRACT

The present invention is directed to an arcade game with a rotating playing field and a radially projecting mechanism for moving targets located on the spinning mechanism board. Having the mechanism be radially projecting allows for more players by reducing the playing area that each player occupies. In a first embodiment, the player uses a vacuum mechanism. In another embodiment, the player uses a pusher to direct targets or prizes off the playing field in the radial direction. The pusher mechanism can push the targets toward the player (into a retrieval bin) or off the playing field at the center of the game. In a preferred embodiment, the game automatically replaces each displaced target with a new target so that the game always maintains the same number of targets on the playing field.

6 Claims, 5 Drawing Sheets

FIG. 5
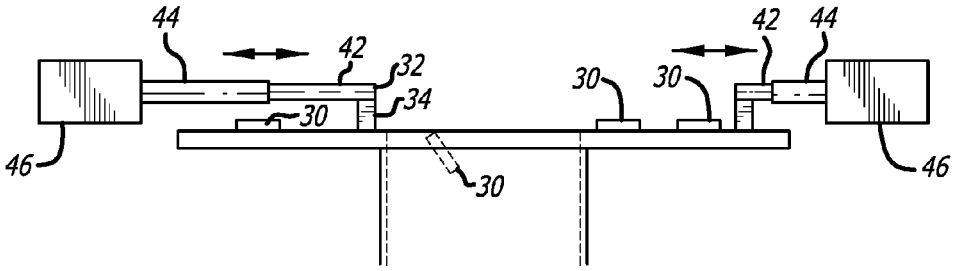
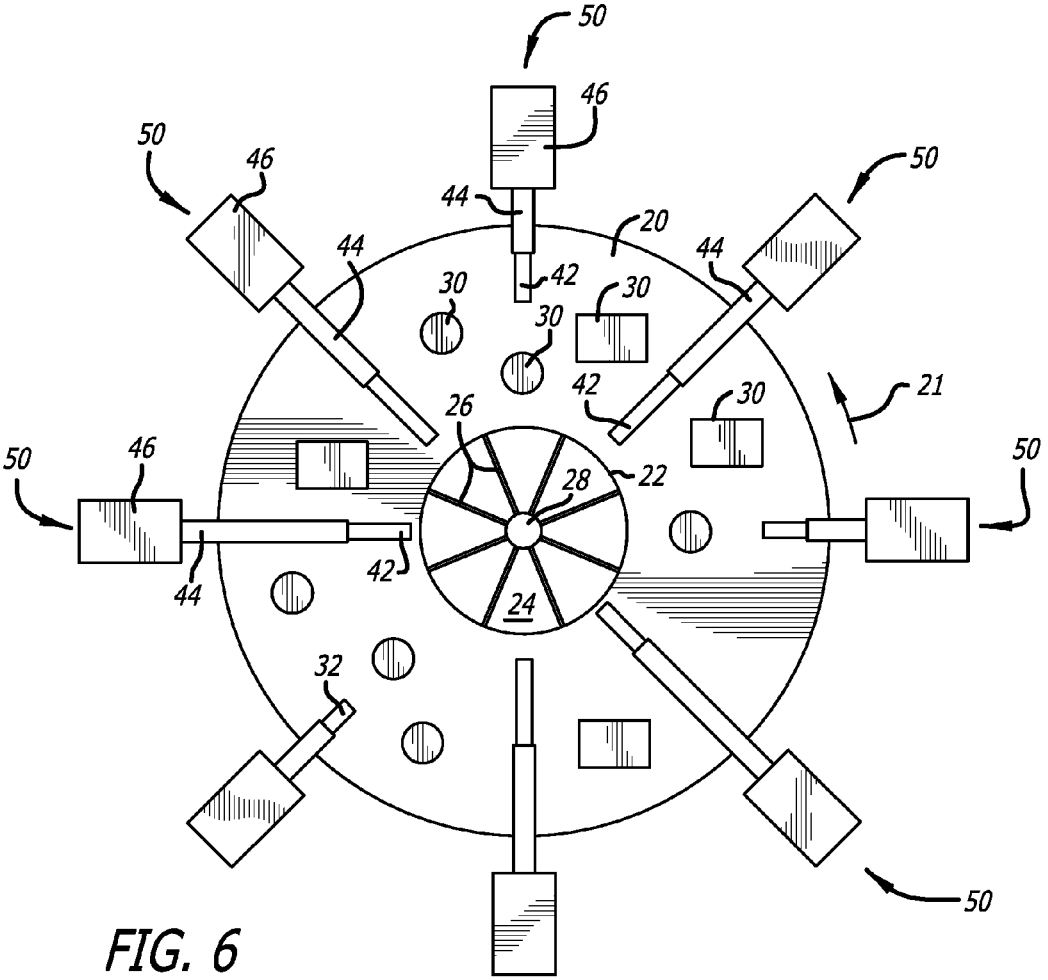
FIG. 6

ARCADE GAME WITH ROTATING TARGETS

BACKGROUND

The present invention relates generally to arcade games, and more particularly to an arcade game with a rotating prize table where players attempt to remove a prize or target from the rotating table using a radially oriented vacuum mechanism. In a preferred embodiment, the game automatically replaces targets/prizes as they are swept or carried off the table.

Arcade games come in many shapes and sizes, from the early pinball games to the new video-centric consoles with large screens, sound effects, and virtual reality elements. However, the allure of actual physical game elements that can be maneuvered, aimed, shot, contacted, and won are still among the most popular types of games.

It is also known to have a game with a rotating playing field. U.S. Pat. No. 5,855,374, entitled "CRANE GAME INCLUDING VACUUM AND ROTARY TABLE," by the present inventor illustrates a common type of arcade game with a rotating playing field. See also U.S. Pat. No. 8,568,214, entitled "ARCADE GAME WITH ROTATING AND COUNTER ROTATING POINTER AND TURNTABLE," the contents of which are fully incorporated herein by reference.

Floor space in an arcade or other location where amusement games are displayed is always at a premium. For games to be profitable, they must maximize their potential to reach and capture many players to justify their presence in the arcade. One way to maximize the profitability of a game is to increase the number of players that may play a game at a given time. If a game can increase the opportunity for eight players to play instead of one, the game may optimize its potential earning capacity over single play games and generate additional excitement for multiple players. The present invention looks to increase the number of players who can play such a game by presenting a game that, while incorporating a rotating playing field, uses radially aligned target acquisition mechanisms that allow many players to stand or be seated around the game and each player can play simultaneously. This greatly increases the profitability of the game, and the cost to manufacture is less because each section is replicated from the first section.

SUMMARY OF THE INVENTION

The present invention is directed to an arcade game with a rotating playing field and a radially projecting mechanism for removing targets on the spinning board. Having the mechanism be radially projecting allows for more players by reducing the playing area that each player occupies. Prior art games required a pusher mechanism that moved in an arc along the surface, and thus required a lot of space to operate. In the present embodiment, the player controls a radially aligned vacuum device to capture and remove prizes from the playing field. A motorized control system may cause the pick-up device to continuously move back and forth and be controlled by a timer. The movement can be continuous as long as the game is powered up, or simply when the player initiates play. The control system motor starts and the vacuum unit motor also starts and the vacuum pump is turned on. A pulley on the vacuum unit is larger than the control unit and has a weaker clutch. Thus, as the control unit goes back and forth the vacuum unit it dragged along, always held against the control unit. The player pushes a down button and the vacuum motor reverses and goes down. The rotating playing surface can stop or keep spinning/moving, depending on a switch setting. If the prize wheel stops, the game is easier. When the vacuum cup makes contact with a surface of a prize or the playing surface, a switch causes the motor to reverse, causing the pick-up device to move upward. If the vacuum cup is on a prize the prize is picked up, and the vacuum switch locks to signal that there is a winner. If there is no winner, the vacuum cup does not stick to the wheel as the surface is such that it will not create a vacuum.

If there is a winner the vacuum cup and prize move forward to a stop, the pump is turned off, a valve releases the vacuum, and the prize drops into the prize chute to the player. The motor reverses; the vacuum pump is turned on, the unit moves to the other back stop. The vacuum cup then goes down into a tube holding reserve prizes. The uppermost prize is picked up, raised, moved forward a short time and the new prize is dropped onto the rotating circle. The game is now ready for another player. In a preferred embodiment, the game automatically replaces each displaced target/prize with a new target so that the game always maintains the same number of targets on the playing field. The replacement targets can be randomly dispersed or replaced at the exact location where the prize was removed. In the latter case, the replacement mechanism can be a prize dispenser located below the table that detects when a prize is removed and shifts a new prize from a stack of prizes into the position occupied previously by the old target. In an alternate embodiment, the player controls a pusher mechanism that sweeps a prize off the rotating table into a retrieval compartment that allows the player to collect the prize.

BRIEF DESCRIPTION OF THE DRAWINGS

FIG. 5 is a side view of a fourth preferred embodiment of the present invention; and FIG. 6 is a top view of the embodiment of FIG. 5.

DETAILED DESCRIPTION OF THE PREFERRED EMBODIMENTS

Figure 1:
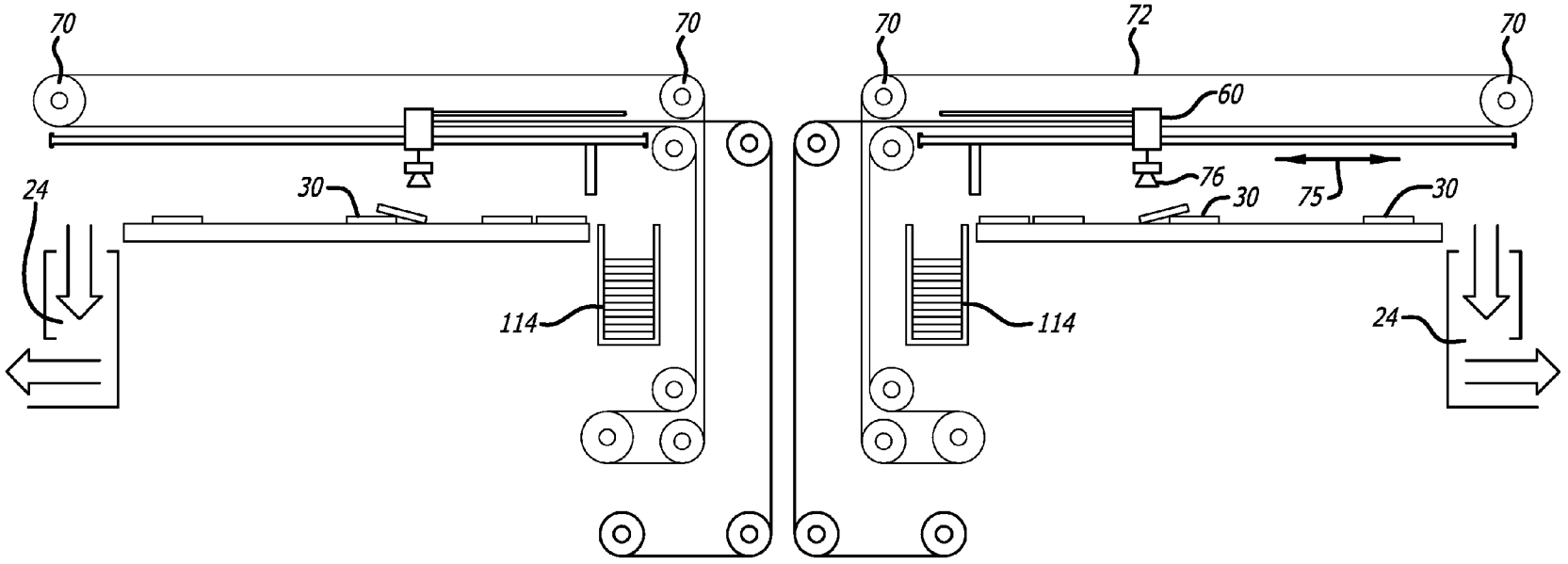
FIG. 1 is a side view of a first preferred embodiment of the present invention.

The present invention incorporates a rotating playing field in an arcade game such as the type described in U.S. Pat. No. 6,991,230 and U.S. Pat. No. 7,559,552, the contents of each of which are fully incorporated herein by reference. The present invention differs from the earlier games in that it is a multi-player game where players compete concurrently on the same playing field, thereby increasing the opportunity for participation and the revenues for the game operator. The playing field 20 rotates in the direction of arrow 21 by a conventional motor arrangement well known in this art and omitted herein for brevity. In the center of the playing field may be a circular opening 22 that is divided into pie shaped sectors 24 that correspond to a separate player station. That is, each player station has an associated sector of the playing field opening 22 defined by dividers 26 emanating radially from a central pole 28. Each sector 24 leads to a compartment below the playing field 20 that is accessible to a player at the corresponding player station. Alternately, the player's retrieval compartment 114 may be adjacent the player on the periphery of the playing field.

On the playing field is a number of prizes or targets 30, which can be poker chips, baseball cards, gift cards, playing cards, tokens, or other symbolic or actual value objects that can be collected by a player. For example, gift cards having a monetary value that can be redeemed later at the arcade, or other restaurants or stores, can be used in the game and take up much less space that other conventional arcade game prizes, allowing the game operator to spend less time refilling the game prizes. The prizes may vary in value, creating a competition among players for the best prizes, or the prizes may all have the same value.

Figure 2:
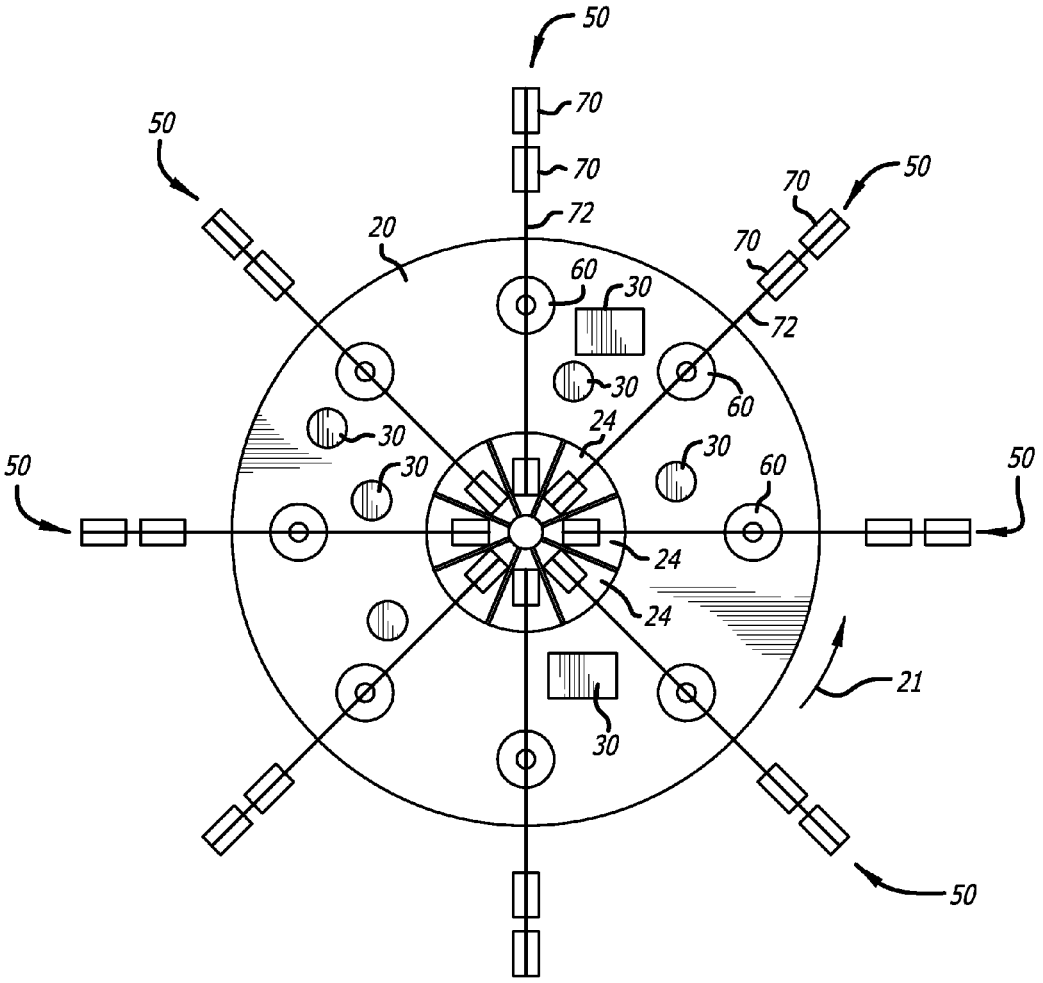
FIG. 2 is a top view of the embodiment of FIG. 1.

FIGS. 1 and 2 illustrate a first embodiment of the present invention, where a vacuum pick-up device 60 is radially aligned for each player. The vacuum pick-up devices 60 are similar to those shown in U.S. Pat. No. 8,070,167, the contents of which are fully incorporated herein by reference. The vacuum pick-up device is maneuvered in a radial direction along arrows 75 with respect to the playing field 20 along a cable 72 and pulley system 70. The player via the player controls 8 maneuver the pick-up device along the pulley system 70 and cable 72 to a position along a radial line between the center of the playing field and the player station 50. The player then lowers the pick-up device 60, which includes a vacuum cup 76 and a vacuum hose 78 that leads to a vacuum source (not shown). The prizes 30 all have smooth upper surfaces, like gift cards, baseball cards, poker chips, and the like, which enable the pick-up device 60 to establish an effective contact with the prize for vacuuming the prize. The prize may be thick enough so that a vacuum is not created if the cup it over the edge of the target. The surface of the playing field 20, however, is rough (e.g., felt or other uneven surface) that prevents an effective suction with the pick-up device. Thus, unless the pick-up device makes a clean and direct contact with a prize, the pick-up device will not make a clean contact with the surface of the playing field and no prize can be extracted from the game.

The player thus maneuvers the pick-up device along the radial line associated with his or her playing station 50, and then lowers the pick-up device onto a prize as it rotates below on the rotating playing surface 20. If the pick-up device lands on a prize, the pick-up device carries the prize 30 to the sector 24 associated with the playing station, where the prize is released by removing the vacuum from the pick-up device. The prize then falls into the sector, where it can be claimed by the player in the retrieval bin.

Figure 3:
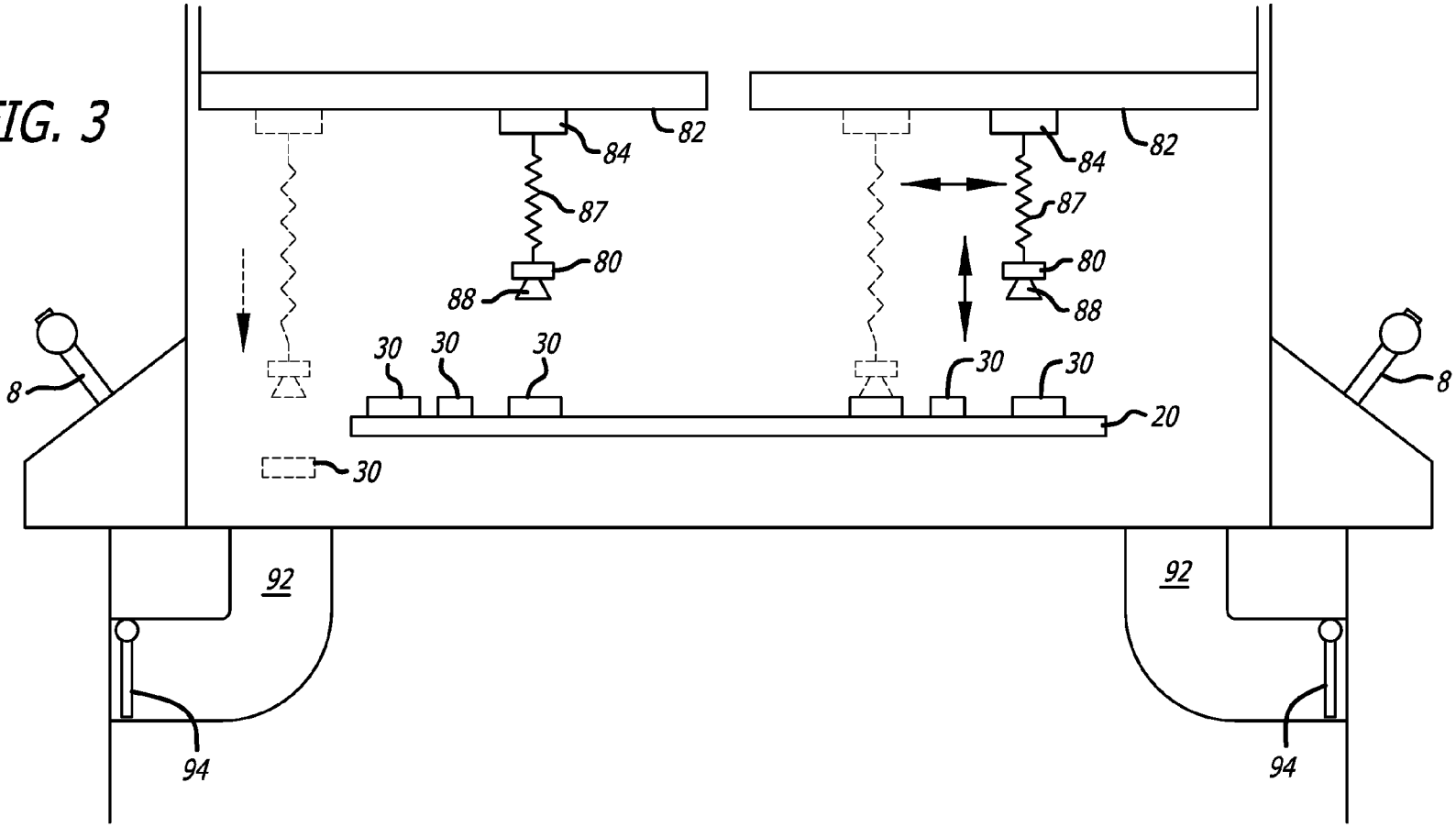
FIG. 3 is a side view of a second preferred embodiment of the present invention.

FIG. 3 illustrates a side view of another type of pick-up device 80, which moves along a track 82 suspended from a carriage 84. The player via controls 8 moves the carriage 84 along the track 82, and then lowers the pick-up device 80 onto the playing surface of playing field 20. A vacuum tube 87 connects to a suction cup 88 to pick up prizes on the playing field 20. Once the prize 30 is captured by the pick-up device 80, the carriage 84 returns to a position over a passage 92 that may be elbow shaped and lead to a door 94 at the end of the passage 92. The pick-up device then drops the prize 30 down the passage 92, where the player can open the door 94 and remove the prize. The prize is dropped by the cessation of the vacuum at the suction cup 88, removing the force on the prize and allowing gravity to convey the prize to the player via the passage 92. Other means for retrieving the prize could be substituted for the gravity-assisted passage without departing from the scope of the invention.

Figure 4:
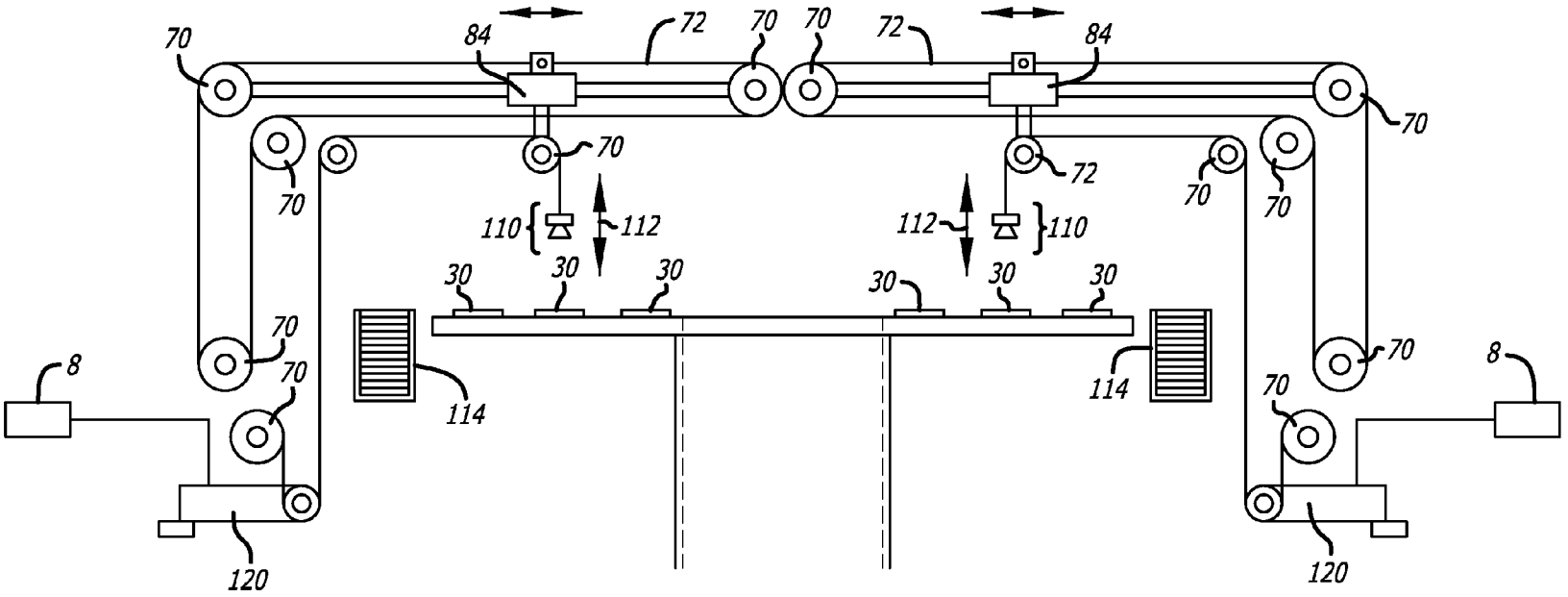
FIG. 4 is a side view of a third preferred embodiment of the present invention.

FIG. 4 illustrates another embodiment of the present invention where the game automatically replaces prizes won. A pick-up device 110 moves vertically in the direction of arrows 112 through manipulation of player controls 8 (which may be a joystick, buttons, a touch pad, or any other manually operated controls). A motor 120 moves the cable 72 that causes the carriage 84 to move along a radial path in the forward and rearward directions as controlled by the player. The pick-up device 110 then drops the prize 30 into the player's sector to a retrieval bin accessible by the player. The pick-up device then moves over a silo 114 of prizes and lifts an uppermost prize of the stack inside the silo 114. The pick-up device then moves over the playing field 20, and randomly drops the prize on to the upper surface of the playing field. In this manner, there is always a constant number of prizes on the table no matter how many players win prizes, ensuring a more fair and attractive game.

In FIGS. 5 and 6, the object of the game is for a player to push a prize 30 using a pusher mechanism 40 into the player's sector as the prizes 30 rotates past the player on the rotating playing field 20. The pusher mechanism 40 is comprised of a pair of telescoping shafts 42,44 such as a 1.8 inch shaft that reduces to a 1.4 inch rod, and a spacer 34 coupled to a light spring (not shown) where the surface of the pusher mechanism under the force of the spring lightly brushes against the surface of the rotating playing field. The shafts extend from a base 46 set just off the playing field 20. The pusher mechanism 40 extends the telescoping shafts in response to player controls 8 to extend the telescoping shafts 42,44 toward the player's sector 24. A player starts the game and waits until a desired prize in the right position to be pushed off the table, and then actuates the pusher mechanism. The pusher mechanism moves from the center of the table to the inner edge, and the spacer 34 makes contact with any prize in the path of the pusher mechanism, driving the prize into the player's sector if the player times the operation of the pusher mechanism properly. The table is designed so that the spacer 34 will not travel beyond a predetermined location, such as the edge of the table. If no prize is removed from the table, the pusher mechanism resets to its original position; however, if a prize is won, lights flash, sirens sound, and the game recognizes the winning effort. The game in a preferred embodiment has an automatic sensor that determines when a prize has been won, which may be accomplished in many ways. The sector 24 leads to a retrieval compartment that allows the player to collect the prize and redeem or possess the prize. Note that FIG. 6 illustrates eight (8) player stations 50 that would allow eight different players to participate simultaneously in the operation of the game, although it is understood that more or fewer player stations 50 could be designed for the game's operation.

Each of these various embodiments are intended to be illustrative of the greater concept of the invention and not limiting in any way. The drawings are not intended to be limiting, but rather teach the aspects of the invention in various ways. Accordingly the scope of the invention is properly construed as rendered by the appended claims, using the ordinary meanings, without limitation to any specific description or depiction herein.

I claim:

1. An arcade game having a flat playing field that rotates about a center and past a plurality of playing stations having sets of player controls, and a plurality of targets dispersed on the playing field, the game comprising: a plurality of vacuum pick-up devices each moving exclusively radially along a respective line between a set of player controls and a center of the playing field, the pick-up device including a suction cup and vacuum means for picking up a target and moving the target inward toward a respective collection area along said respective line, the collection area for each player having an entrance located at a center of the playing field and accessible by a player controlling the pick-up device to claim the target below the playing field; and a target distribution device for replacing a target won by a player automatically by delivering a replacement card to the playing field, the target distribution device comprises a stack of targets and that an uppermost target is dropped onto the playing surface after a target is removed through winning the game to maintain a constant number of targets on the playing field; wherein the pick-up device moves to the target distribution device and removes an uppermost card and drops the uppermost card onto the playing field after a card is removed through winning the game; wherein each vacuum pick-up device is controlled by its own pulley system, where the pulley system includes a cable that extends both above and below the rotating playing field; wherein up to eight players or more can play simultaneously at eight separate playing stations; and wherein the pick-up device drops vertically onto the playing surface upon control by the player to land on a target and establish a suction-sustaining connection to lift the target and drop the target into the collection area.

2. The arcade game of claim 1, wherein the targets comprise gift cards.

3. The arcade game of claim 1, wherein the pick-up device is controlled by a pulley and cable system that is connected to a motor.

4. The arcade game of claim 1, wherein an upper surface of the playing field is uneven to prevent the pick-up device from creating a suctional connection to the upper surface of the playing field.

5. The arcade game of claim 1, wherein the collection area is located between the playing field and the player controls.

6. The arcade game of claim 5, further comprising a door and a drop area between a retrieval bin and the outside of the game.

* * * * *